US006257431B1

(12) United States Patent
Baudin

(10) Patent No.: US 6,257,431 B1
(45) **Date of Patent: *Jul. 10, 2001**

(54) DISPENSING CAP WITH IMPROVED TIGHTNESS

(75) Inventor: Gilles Baudin, Domont (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 30 days.

This patent is subject to a terminal disclaimer.

(21) Appl. No.: 09/065,095

(22) PCT Filed: Aug. 28, 1997

(86) PCT No.: PCT/FR97/01535

§ 371 Date: Aug. 10, 1998

§ 102(e) Date: Aug. 10, 1998

(87) PCT Pub. No.: WO98/08746

PCT Pub. Date: Mar. 5, 1998

(30) Foreign Application Priority Data

Aug. 29, 1996 (FR) ..... 96 10576

(51) Int. Cl.[7] ..... B65D 47/08

(52) U.S. Cl. ..... 215/237; 215/341; 220/849; 222/546; 264/328.8

(58) Field of Search ..... 220/838, 849; 215/235, 237, 341, 342, 352, 303–305; 222/546, 556; 264/328.8

(56) References Cited

U.S. PATENT DOCUMENTS

| | | | | |
|---|---|---|---|---|
| 806,602 | * | 12/1905 | Uhl | 215/352 X |
| 2,394,135 | * | 2/1946 | Baar | 215/303 |
| 2,572,383 | * | 10/1951 | Porter | 215/352 X |
| 2,839,210 | * | 6/1958 | England, Jr. | 215/303 |
| 4,027,789 | * | 6/1977 | Dickey | 222/190 |
| 4,188,457 | * | 2/1980 | Thorp | 215/355 X |
| 4,261,475 | * | 4/1981 | Babiol | 215/341 |
| 4,332,858 | * | 6/1982 | Saitoh et al. | 428/412 |
| 4,569,457 | * | 2/1986 | Hatakeyama et al. | 215/364 |
| 4,582,207 | * | 4/1986 | Howard et al. | 215/247 |
| 4,657,152 | * | 4/1987 | Carveth et al. | 215/349 |
| 4,711,360 | * | 12/1987 | Ullman | 215/235 |

(List continued on next page.)

FOREIGN PATENT DOCUMENTS

| | | | | |
|---|---|---|---|---|
| 211853 | * | 12/1957 | (AU) | 215/341 |
| 2355818 | * | 11/1973 | (DE) | 215/235 |
| 771846 | * | 5/1997 | (EP) . | |
| 816245 | * | 1/1998 | (EP) . | |
| 1387064 | * | 3/1975 | (GB) | 215/305 |

* cited by examiner

*Primary Examiner*—Stephen P. Garbe
*Assistant Examiner*—Joe Merek
(74) *Attorney, Agent, or Firm*—Oblon, Spivak, McClelland, Maier & Neustadt, P.C.

(57) ABSTRACT

A dispensing cap which fits on a container containing a fluid product. The cap includes a body provided with a dispensing orifice and a hinged lid which is hinged to the body about an axis. The body and lid are made of a rigid or semi-rigid material. The lid includes a plugging pip for plugging the dispensing orifice when the lid is closed. A coating of elastomeric material is arranged on the outer wall of the pip to produce a seal between the pip and the orifice when the lid is closed.

22 Claims, 2 Drawing Sheets

U.S. PATENT DOCUMENTS 4,850,483 * 7/1989 Stack ..... 206/315.9
5,002,625 * 3/1991 Naritomi et al. ..... 156/245
5,083,835 * 1/1992 Rossini ..... 296/201
5,110,002 * 5/1992 Trucker ..... 220/849 X
5,149,589 * 9/1992 Naritomi et al. ..... 428/412
5,221,017 * 6/1993 Cistone et al. ..... 220/335 X
5,289,930 * 3/1994 Inouye ..... 215/235
5,328,058 * 7/1994 Leoncavallo et al. ..... 222/153.14
5,385,257 * 1/1995 Hung ..... 220/849 X
5,437,383 * 8/1995 Stull ..... 215/235
5,443,172 * 8/1995 Gabriele ..... 215/303
5,501,348 * 3/1996 Takeuchi ..... 215/235
5,562,979 * 10/1996 Easterlow et al. ..... 428/327
5,743,443 * 4/1998 Hlns ..... 222/490
5,766,651 * 6/1998 Massano ..... 425/13
5,769,253 * 6/1998 Gross ..... 215/235 X
5,782,388 * 7/1998 De Nervo ..... 222/546
5,807,639 * 9/1998 Frappier et al. ..... 428/475.5
5,865,353 2/1999 Baudin .
5,910,540 * 6/1999 Takahashi ..... 525/92 B
5,924,605 * 7/1999 Baudin et al. ..... 222/494

DISPENSING CAP WITH IMPROVED TIGHTNESS

BACKGROUND OF THE INVENTION

1. Field of the Invention

The present invention relates to a dispensing cap intended to be fitted to a container containing a fluid product to be dispensed, and to a dispensing assembly equipped with this cap. It is equipped with a stoppering system which can be opened for dispensing the product, and closed for keeping it.

2. Discussion of the Background

Containers fitted with caps of this kind are customarily used in various fields, for storing and dispensing liquid products, for example in the fields of cosmetics, foodstuffs, household, pharmacy or personal hygiene. These products are, in particular, shampoos, antiseptics, household cleaners, or washing-up products. Thanks to the use of a cap of this kind, on the one hand, it is possible, to prevent the product from spilling out during transport and storage and, on the other hand, the product is protected from dirt from the outside. Furthermore, by using such a cap the user can easily and in a controlled way dispense the product contained in the container.

More particularly, the present invention relates to a cap comprising a product-dispensing orifice and a hinged lid, the system for stoppering the orifice consisting of a pip borne by the lid and designed to close this orifice.

The pip introduced into the dispensing orifice needs to fulfil several functions; it must guarantee a good seal; the force required to open it must be reasonable; and, upon opening, an explosive noise must not be produced. These qualities need to be provided throughout the use of the product. Now, with the materials such as polyethylene or polypropylene, commonly used for injection-moulding such caps, dimensional adjustment is very tricky because the tolerances need to remain tighter than 0.05 mm, especially as there is a risk of additional deformation occurring during removal from the mould. Furthermore, under intense use, and through wear of the pip and/or of the orifice, this pip no longer enters the orifice with friction, and leaks of product can therefore occur.

A dispensing cap of the kind mentioned hereinabove is described, for example, in FR-A-2,662,144. This document describes a dispensing cap comprising a dispensing orifice and a hinged lid equipped with a hollow pip, intended to stopper the dispensing orifice when in the storage position, this pip being in the form of a cylindrical skirt. According to this document, the dispensing orifice is made in a flat portion, at right angles to the longitudinal axis of the cap, this portion being made of thermoelastic rubber.

This cap of the prior art has the drawback that when the lid is closed, a relatively high amount of force is needed to engage the pip in the dispensing orifice. This is because during the closure operation, the pip is in contact with the edge of the orifice, and before it engages in the orifice, it pushes the said rubber portion back.

There is also known, from U.S. Pat No. 5,169,035, a cap similar to the aforementioned cap, the dispensing orifice being made by an annular component made of elastomer, which is clipped into an opening in the upper face of the cap and is able to be plugged by a pip carried by the lid articulated to the cap.

Although the cap according to U.S. Pat. No. 5,169,035 makes it possible to obtain leaktight stoppering of the dispensing orifice by the pip, it does have the following drawbacks: on the one hand, the annular elastomer component has to be quite thick to allow it to be held in the opening of the cap; and on the other hand, the choice of elastomers that can be used for producing the annular piece is limited. This is because with a view to both flexible and leaktight engagement of the pip in the dispensing orifice it would be desirable to use so-called "soft" elastomers (that is to say elastomers with a hardness of less than about 60 Shore A). Now, to ensure that the annular elastomer component is held correctly in place in the opening of the cap, this material has to have a hardness in excess of 60 Shore A, which is prejudicial to the desired flexible operation and desired sealing of the cap. Furthermore, using such a material, the dimensional tolerances on the pip and the tolerances on positioning it with respect to the dispensing orifice may not be very well met. Finally, to mount the annular elastomer component in the orifice from inside the cap is a relatively complicated operation requiring special appropriate tooling.

SUMMARY OF THE INVENTION

It is a first object of the present invention to provide a dispensing cap which operates flexibly when being opened or closed, under good conditions of sealing and the cost of which is competitive.

A second object of the invention is to provide a dispensing cap for which it is easy to adjust the tolerances on the dimensions of the pip and/or of the dispensing orifice and any moulding/demoulding defects of which can be compensated for. It is a further object of the invention to create a particularly well sealed stoppering system, which resists wear throughout the life of the product and operates flexibly, and is easy to open and close. Furthermore, the invention also targets the use of orifices of non-circular cross-section, hitherto unknown in the aforementioned fields of use.

The objects mentioned hereinabove are achieved by depositing a coating of elastomeric material on the outer wall of the pip. Depositing this coating, assuming it is achieved by duplex-injection or by overmoulding onto the pip, is easier to achieve than producing, as in the prior art, a dispensing orifice made in a region made of elastomer. Furthermore, producing a coating on the outer wall of the pip makes it possible, on the one hand, to produce this coating as a thin layer, and therefore make a saving on material, and, on the other hand, to use particularly flexible elastomers (with a hardness of less than 60 Shore A), which makes the cap flexible to use and provides a perfect seal.

Thus, a first aspect of the invention relates to a dispensing cap intended to be fitted to a bottle containing a fluid product, comprising a body provided with a dispensing orifice and with a hinged lid articulated to the body about an axis, the body and the lid being made of a rigid or semi-rigid material, this lid being provided with a plugging pip intended to plug the dispensing orifice, in the storage position. According to the invention, a coating of elastomeric material is arranged on the outer wall of the pip, to produce a perfect seal between the pip and the orifice when the lid is closed in the said storage position.

Another aspect of the invention consists of a dispensing assembly comprising a container of a product, equipped with a cap in accordance with the first aspect.

In general, the container equipped with such a cap consists of a fairly flexible bottle, or alternatively a compressible tube. As a preference, the container has a neck onto which the dispensing cap is fixed by screwing, snap-fastening, overmoulding, welding or any other known means.

The product to be dispensed can flow out under its own weight and is, for example, shampoo or a body milk with a viscosity generally within a range from 50 mPa.s to 5 Pa.s or alternatively a powdered product.

The dispensing orifice may have a circular, oval, polygonal or elongate cross-section, the cross-section section of the pip complementing that of the orifice. Thanks to the invention, it is conceivable for orifices, especially those with a non-circular cross-section to be produced, without this resulting in sealing problems.

Thanks to the flexibility of the coating, minor defects in the positioning of the pip with respect to the orifice can be compensated for. The same is true, for differences in respective diameters of the orifice and of the pip. In particular, when there is the desire to make orifices of non-circular shape, for example in the shape of a star or flat strip, a good seal can be obtained by arranging a coating of elastomeric material on the external wall of the pip, while at the same time ensuring that the opening and closing of the dispensing orifice will be flexible.

Advantageously, the outer coating on the pip has a thickness of from about 0.1 mm to about 3 mm.

According to another advantageous feature of the invention, it is possible to produce a hollow pip, formed of a cylindrical skirt. In this case, the internal volume of the pip may be filled with flexible material. This is advantageous, because it avoids temporarily trapping residual product inside the pip, which product could run out unintentionally as the lid is opened and dirty the work surface.

Advantageously, the lid is articulated to the cap body using a hinge pivoting about an axis. This hinge is preferably a film hinge moulded integrally with the cap body and lid.

As a preference, the cap and its lid are made of a rigid or semi-rigid thermoplastic, for example polypropylene or either high or low density polyethylene.

According to a first embodiment, the flexible material may be a thermoplastic elastomer physico-chemically compatible with the rigid or semi-rigid material and capable of forming, when the cap is produced, for example by duplex injection or overmoulding, a link by fusion with the rigid or semi-rigid material.

According to this embodiment, this thermoplastic elastomer is advantageously chosen from the group of polyether block amide elastomers, polyvinyls; terpolymers of ethylene, propylene and a diene (EPDM); styrene-ethylene-butadiene block copolymers (SEBS-SIS).

According to another embodiment, the flexible material is chosen from natural or synthetic rubbers, or alternatively from silicone rubbers.

According to yet another embodiment, the said coating consists of an attached part made of elastomer, deposited on the outer wall of the pip by assembly.

Advantageously, this assembly may be achieved, for example, by snap-fastening, bonding, welding, drawing, upset heading or any other appropriate means. Mounting it by drawing is particularly advantageous in that it allows thinner thicknesses.

Advantageously, the flexible material is chosen such that the coating has a hardness of from 20 Shore A to 90 Shore A, and preferably of from 30 Shore A to 60 Shore A.

The cap of the invention may be equipped with a certain number of additional features, described below.

Thus, part of the body and/or of the lid may be provided with a gripping region comprising a region made of flexible material, produced at the same time as the coating on the pip, by overmoulding or duplex injection of the cap body. This gripping region makes the lid easier to open and close on account of the non-slip effect displayed by certain elastomers. This is advantageous, especially when the user has wet hands, for example when in the shower.

Furthermore, the body of the cap may have an annular gasket made of flexible material, in sealed contact with a peripheral edge of the lid, when the lid is flipped down.

It is also conceivable to provide a spring "toggle effect" hinge by using at least one connecting element made of flexible material, which is elastically deformable in extension, forming a spring. In this case, one of the ends of the connecting element is secured to the body, and the other is secured to the lid. The connecting element is mounted in such a way that it lies on one side of the axis of pivoting of the lid when the lid is open, and on the other side of the axis of pivoting when the lid is closed. The connecting element undergoes elongation as it passes from the open position to the closed position, and vice versa, the maximum extension being reached as the connecting element crosses the axis of pivoting. This element can hold the lid in two extreme positions: in a fully open position or in a closed or almost closed position, as desired.

The provisions mentioned hereinabove, namely the elastic band, the external coating of the pip or internal coating of the orifice, the overmoulding of the gripping regions and the annular gasket, may be achieved in a single manufacturing step using the duplex-injection method, which consists in firstly injecting as one single part, in an appropriate mould, the cap hinged to the lid made of rigid material; and secondly forming the elastic band, the coating of the pip or of the orifice, and overmoulding the gripping regions and making the annular gasket made of flexible thermoplastic.

BRIEF DESCRIPTION OF THE DRAWINGS

In order to make the invention easier to understand, there will now be described, by way of purely illustrative and non-limiting examples, two embodiments of a dispensing cap according to the invention, with reference to the appended figures.

DISCUSSION OF THE PREFERRED EMBODIMENTS

Figure 1:
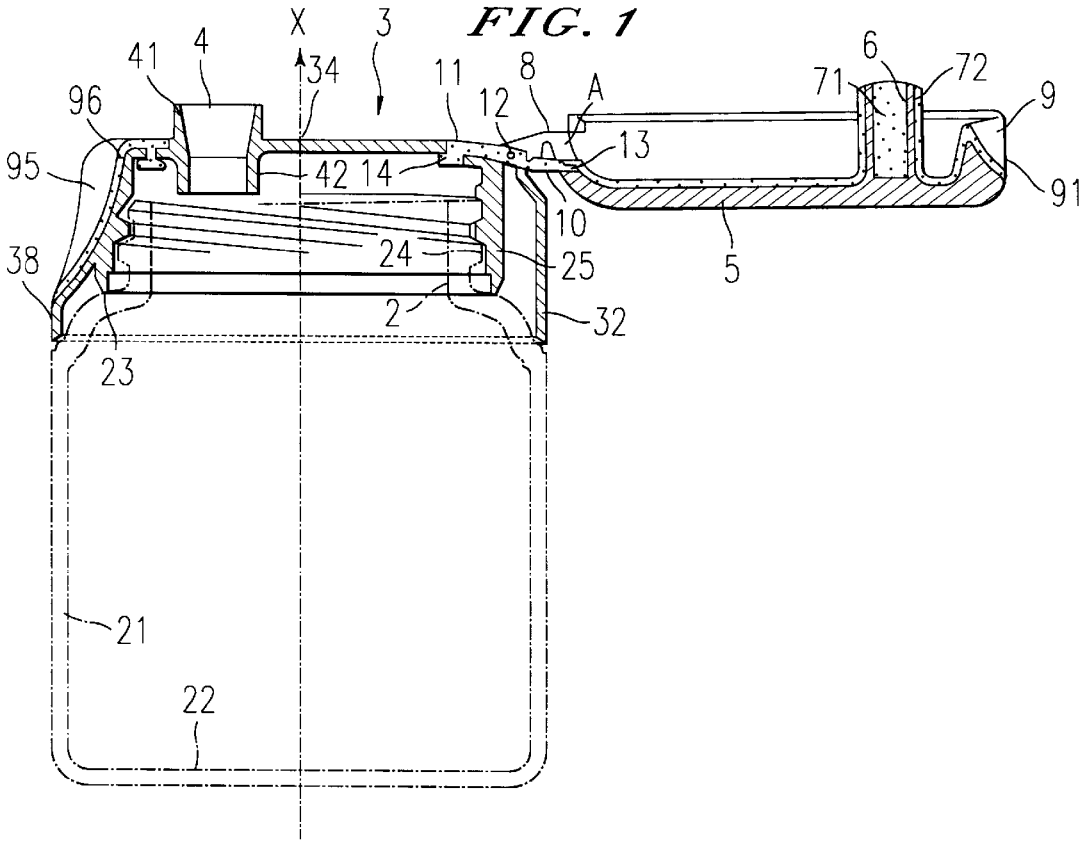
FIG. 1 depicts, in axial section, a dispensing assembly, opened, comprising a container fitted with a dispensing cap according to the invention.

With reference to FIG. 1, it is possible to see a dispensing assembly denoted overall by the reference 1, comprising a container 21 having a longitudinal axis X, fitted with a dispensing cap 3 provided with a body referenced 32. The container 21 has a closed bottom 22, and at the opposite end from the bottom, a neck 2 with an external screw thread 24 for attaching the cap body 32 to the container. For this, the cap body has a cylindrical internal skirt 25 with an internal screw thread that complements the screw thread 24 on the neck 2. The container 21 has a circular or oval overall cross-section, this cross section may be any kind, for example polygonal or asymmetric. It is made, for example, of high density polyethylene. The cap body, for its part, is made of a rigid material, such as polypropylene.

The body 32 of the cap 3 has a plateau 34, provided over a portion of its periphery, with a film hinge 8, via which a lid 5 is articulated, allowing this lid to pivot about an axis A constituting the axis of the hinge. The lid 5 has the shape of a cup with a peripheral edge 51 facing towards the container. Provided in the plateau 34, on the opposite side to the hinge 8 and in a plane passing through the hinge and through the axis X of the container 21, there is a dispensing orifice 4. The orifice 4 is defined by a cylindrical nozzle 41, 42 extending on either side of the plateau 34. An emerging part 41 of the nozzle has a conical internal shape, widening towards the outside. This nozzle constitutes a flow reducer, the emerging part 41 acting as a pouring spout.

The hinge 8 is formed in two parts 8*a*, 8*b* separated by an opening 8*c*. Two orientation strips 12, 13 parallel to the axis A pass through the opening. These strips 12, 13 are embedded in a flat band 10 of elastomeric material and constitute means of anchoring the band. The ends of this band are secured to the body 32 of the cap and to the lid 5 respectively, this band 10 being secured to the body 32 and to the lid 5 by fusion of the respective materials during manufacture of the cap 3. In order to strengthen further the anchorage of the band 10, additional anchoring points 14 may be provided on each adjacent part at the ends of the band 10.

This band 10 is mounted in such a way that it lies on one side of the axis A when the lid 5 is open, and on the other side of the axis A when the lid is closed. Thus the band 10 undergoes elongation as it passes from one of the positions to the other, the maximum elongation being reached when the band 10 crosses the axis A. Once it has passed through the area of maximum elongation, the lid 5 is returned either to its open position, or to its closed or almost closed position using a "toggle effect". From the almost closed position, the lid 5 can be closed completely by making the pip 6 enter the orifice 4, under friction. The flexible band 10 is made, for example, of a blend of polypropylene/styrene-ethylene-butylene-styrene block polymer.

The dispensing orifice 4 is stoppered, when the lid is slipped down, by a pip 6 closing off the tubular part 41. This pip 6 is hollow and has an external coating 72 of flexible material. The inside diameter of the tubular part 41 and the outside diameter of the coating 72 are chosen to be such that the pip 6 can enter the orifice 4 in a sealed way, under friction, when the lid 5 is closed. Advantageously, this diameter is of the order of 3 to 8 mm, and depends on the viscosity of the product to be dispensed. Typically, this viscosity lies within the range from 50 mPa.s to 5 Pa.s.

It is of course possible to make a separate part in the form of a cylindrical sleeve made of elastomer, the inside diameter of which is slightly smaller than the diameter of the pip. After the sleeve has been drawn out radially, it can be placed over the pip and is held in place by elasticity.

Figure 2:
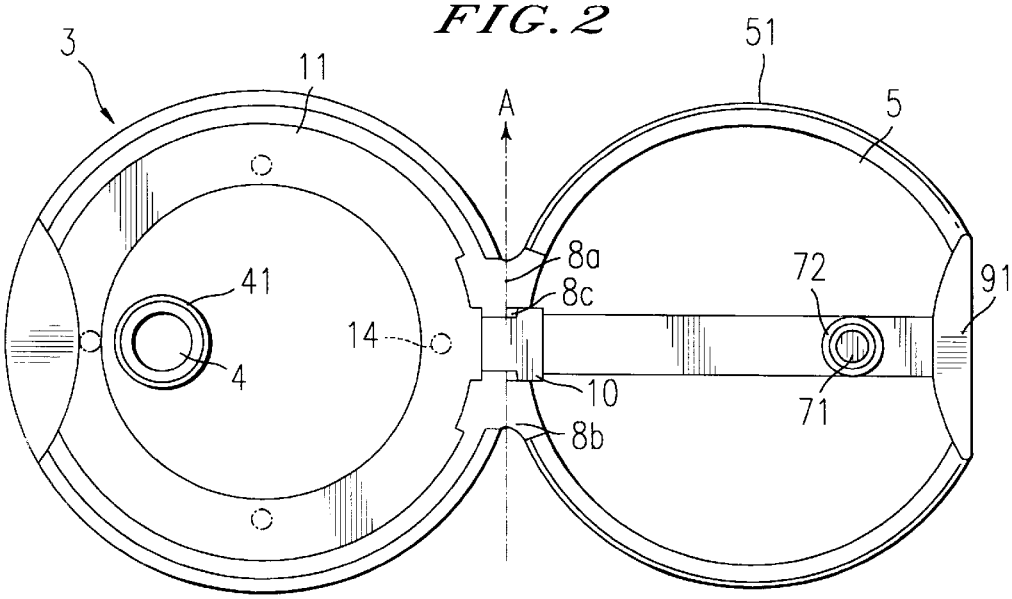
FIG. 2 depicts a view from above of the cap of FIG. 1.

As can be seen in FIGS. 1 and 2, the inside 71 of the pip 6 may be filled with an elastomeric material.

As illustrated, especially in FIG. 2, the plateau 34 also comprises, at its periphery, an annular gasket 11 made of elastomeric material. It is arranged in such a way that the edge 51 of the lid 5 comes to rest against this gasket 11, when the cap is closed.

On the opposite side to the hinge 8, the skirt 37 has a depressed region 95 in the shape of an arc of a circle for example, making the lid 5 easier to grip and to open. The surface 96 of this region is covered with a layer of flexible material. Likewise, the lid 5 has a gripping region 91 in the form of a concave return 9, this region being covered, also, with flexible material. The use of a flexible material for the gripping regions gives the user an agreeable feel and makes the cap easy to manipulate. By selecting a particular flexible material, for example SANTOPRENE® (blend of polypropylene with terpolymers of ethylene, propylene and a diene (EPDM)), marketed by the company AES, it is even possible to obtain a "non-slip" effect which is advantageous when the user is using a surfactant bodywash product in the shower or in the bath.

Figure 3:
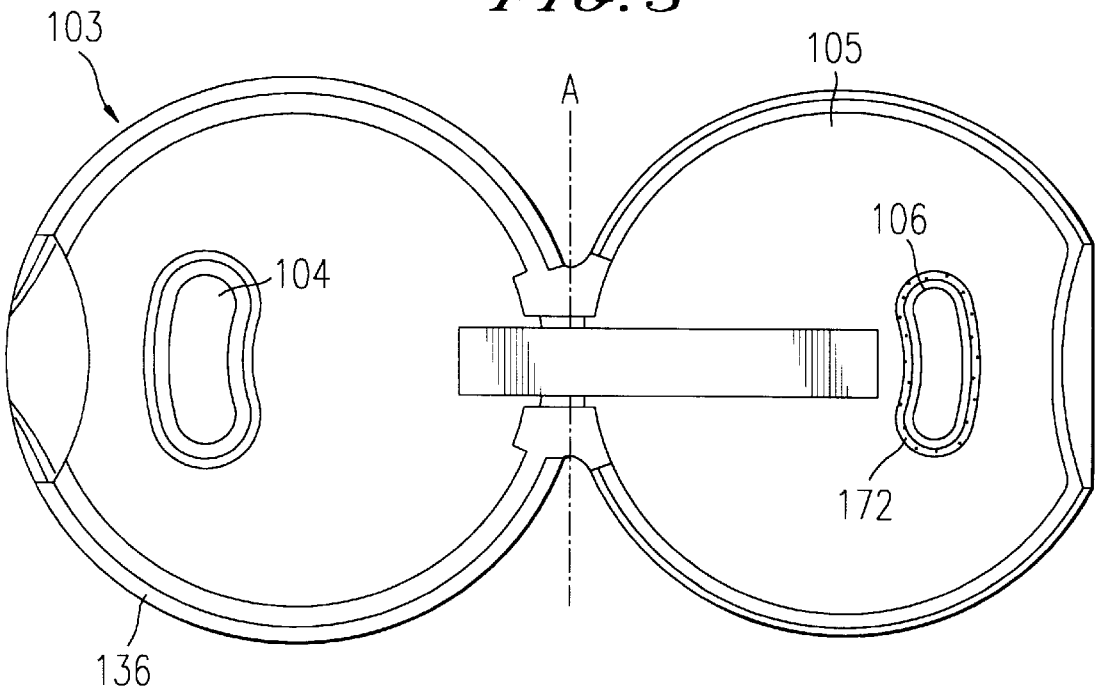
FIG. 3 shows a view from above of an alternative form of the cap of FIG. 1.

FIG. 3 shows a view similar to that of FIG. 2, illustrating an alternative form of the stoppering pip. In this embodiment, a cap 103 has a lid 105 with a pip 106. This pip has an elongate cross-section, curved into the shape of a "kidney bean". It has an external coating 172 of flexible elastomeric material. The corresponding orifice 104 has a complementary shape, which means that the pip can enter this orifice under friction. The kidney bean shape of the orifice 104 and of the pip 106 is given merely by way of example. According to the invention, any other conceivable shape may be envisaged.

The way of producing the cap according to the invention is very simple, allowing it to be manufactured in a single short moulding cycle by injecting the two materials, rigid and flexible, in turn. This cap can therefore be manufactured at an attractive cost.

What is claimed is:

1. Dispensing cap intended to be fitted to a container containing a fluid product, comprising:

a body provided with a dispensing orifice;

a hinged lid articulated to the body about an axis, the body and the lid being made of a rigid or semi-rigid material, said lid being provided with a plugging pip intended to plug the dispensing orifice, when the lid is closed; and a coating of elastomeric material arranged on the outer wall of the pip, to product a seal between the pip and the orifice when the lid is closed, wherein the pip is hollow and full of elastomeric material.

2. Cap according to claim 1, wherein the orifice has a cross-sectional shape taken from the group consisting of circular, oval, polygonal and elongate the cross-section of the pip complementing that of the orifice.

3. Cap according to claim 1, wherein the rigid or semi-rigid material is chosen from the group consisting of polypropylenes and polyethylenes.

4. Cap according to claim 1, characterized in that the elastomeric material is a thermoplastic elastomer physico-chemically compatible with the rigid or semi-rigid material, so as to allow a link by fusion with the rigid or semi-rigid material, the said coating being deposited on the outer wall of the pip by dual injection or overmoulding.

5. Cap according to claim 1, characterized in that the elastomeric material is chosen from the group of elastomers of propylene/ethylene copolymers; polyether block amides; polyvinyls; terpolymers of ethylene, propylene and a diene; styrene-butadiene block copolymers; styrene-ethylene-butadiene block copolymers; thermoplastic polyurethanes; blends of polypropylene with one of the following elastomers: styrene-ethylene-butadiene block polymers; terpolymers of ethylene, propylene and a diene; styrene-butadiene block copolymers.

6. Cap according to claim 1, characterized in that the said coating forms an attached part deposited on the outer wall of the pip by assembly.

7. Cap according to claim 6, wherein the attached part is mounted by one from the group consisting of snap-fastening, bonding, welding, drawing and upset heading.

8. Cap according to claim 1, characterized in that the said coating has a thickness of from 0.1 mn to 3 mn.

9. Cap according to claim 1, wherein the coating has a hardness from 20 Shore A to 90 Shore A.

10. Cap according to claim 1, characterized in that the body and/or the lid is provided a gripping region covered with a layer of elastomeric material.

11. Cap according to claim 1, characterized in that the body comprises an annular gasket made of flexible material, in sealed contact with a peripheral edge of the lid, when the lid is flipped down.

12. Cap according to claim 1, characterized in that the lid is articulated to the body by means of a hinge.

13. Cap according to claim 1, characterized in that it comprises at least one connecting element made of elastomeric material, forming a spring, one of the ends of the connecting element being connected to the body, the other being connected to the lid, the connecting element being mounted in such a way that it lies on one side of the axis A when the lid is open, and on the other side of the axis A when the lid is closed, the connecting element undergoing elongation as it changes from one position to the other, the maximum extension being reached as the connecting element crosses the axis.

14. Assembly for dispensing a fluid product, comprising a container containing a fluid product, equipped with a dispensing cap, characterized in that the cap is a cap in accordance with claim 1.

15. Cap according to claim 2, characterized in that the rigid or semi-rigid material is chosen from polypropylenes or polyethylenes.

16. Cap according to claim 2, characterized in that the elastomeric material is a thermoplastic elastomer physicochemically compatible with the rigid or semi-rigid material, so as to allow a link by fusion with the rigid or semi-rigid material, the said coating being deposited on the outer wall of the pip by dual injection or overmoulding.

17. Cap according to claim 3, characterized in that the elastomeric material is a thermoplastic elastomer physicochemically compatible with the rigid or semi-rigid material, so as to allow a link by fusion with the rigid or semi-rigid material, the said coating being deposited on the outer wall of the pip by dual injection or overmoulding.

18. Cap according to claim 2, characterized in that the elastomeric material is chosen from the group of elastomers of propylene/ethylene copolymers; polyether block amides; polyvinyls; terpolymers of ethylene, propylene and a diene; styrene-butadiene block copolymers; styrene-ethylene-butadiene block copolymers; thermoplastic polyurethanes; blends of polypropylene with one of the following elastomers: styrene-ethylene-butadiene block polymers; terpolymers of ethylene, propylene and a diene; styrene-butadiene block copolymers.

19. Cap according to claim 3, characterized in that the elastomeric material is chosen from the group of elastomers of propylene/ethylene copolymers; polyether block amides; polyvinyls; terpolymers of ethylene, propylene and a diene; styrene-butadiene block copolymers; styrene-ethylene-butadiene block copolymers; thermoplastic polyurethanes; blends of polypropylene with one of the following elastomers: styrene-ethylene-butadiene block polymers; terpolymers of ethylene, propylene and a diene; styrene-butadiene block copolymers.

20. Dispensing cap intended to be fitted to a container containing a fluid product, comprising:

a body provided with a dispensing orifice;

a hinged lid articulated to the body about an axis, the body and the lid being made of a rigid or semi-rigid material, said lid being provided with a plugging pip sized and configured to enter with friction into the dispensing orifice so as to plug said orifice, when the lid is closed; and a coating of elastomeric material arranged on at least the outer wall of the pip, to produce a seal between the pip and the orifice when the lid is closed, wherein the coating of the outer wall of the pip is made by dual injection or overmolding, said elastomeric material being selected from the group of elastic materials physicochemically compatible with said rigid or semi-rigid material.

21. Dispensing cap according to claim 20, wherein said elastic material forms a link with said rigid or semi-rigid material by thermo-fusion.

22. Dispensing cap according to claim 20, wherein said dispensing cap is molded in a single molding cycle.

* * * * *

UNITED STATES PATENT AND TRADEMARK OFFICE

CERTIFICATE OF CORRECTION

PATENT NO. : 6,257,431 B1
DATED : July 10, 2001
INVENTOR(S) : Gilles Baudin

It is certified that error appears in the above-identified patent and that said Letters Patent is hereby corrected as shown below:

Column 6,
Line 39, after "elongate" insert -- , --.
Line 67, change "mn" to -- mm -- (both occurrences).

Column 7,
Line 4, after "provided" insert -- with --.
Line 11, after "a" insert -- film --.

Column 8,
Line 34, change "the" to --a --.

Signed and Sealed this

Twenty-sixth Day of February, 2002

*Attest:*

*Attesting Officer*

JAMES E. ROGAN
*Director of the United States Patent and Trademark Office*